United States Patent [19]

Nishikubo et al.

[11] 4,307,595

[45] Dec. 29, 1981

[54] METHOD OF ROLLING A METAL WORKPIECE

[75] Inventors: Michio Nishikubo; Sei Miura, both of Muroran; Kouki Nanbu, Nogata; Matsuo Ataka, Kitakyushu, all of Japan

[73] Assignee: Nippon Steel Corporation, Tokyo, Japan

[21] Appl. No.: 99,726

[22] Filed: Dec. 4, 1979

Related U.S. Application Data

[63] Continuation of Ser. No. 906,568, May 16, 1978, abandoned.

[30] Foreign Application Priority Data

May 28, 1977 [JP] Japan ..... 52-61752

[51] Int. Cl.[3] ..... B21B 1/00

[52] U.S. Cl. ..... 72/234; 72/366

[58] Field of Search ..... 72/226, 227, 234, 366, 72/199, 250; 164/282

[56] References Cited

U.S. PATENT DOCUMENTS 3,553,997 1/1971 Schoffmann ..... 72/366 X
3,693,393 9/1972 Nellen et al. ..... 72/226
4,074,557 2/1978 Yanagimoto et al. ..... 72/206
4,106,318 8/1978 Yanagimoto et al. ..... 72/199

*Primary Examiner*—Milton S. Mehr
*Attorney, Agent, or Firm*—Wenderoth, Lind & Ponack

[57] ABSTRACT

A metal workpiece is rolled in a rolling mill, including an upstream rolling stand or pinch rolls and more than one stream rolling stand. The roll gaps of the workrolls of the downstream rolling stand are set so that the eqivalent contact angle $\theta e$ ($\theta e = \tan^{-1}(\cos\alpha \times \tan\theta)$ wherein $\theta$ denotes the contact angle between the workrolls in the bottom of the roll groove and the workpiece and $\alpha$ denotes the inclined angle of the groove) is larger than $\tan^{-1}\mu$ ($\mu$ denotes a coefficient of friction between the workpiece and the workrolls at the time of biting therebetween and also is smaller than $\tan^{-1}\mu'$ ($\mu'$ denotes a coefficient of friction between the workpiece and the workrolls when the workpiece is completely bitten between the workrolls and the rolling operation is in progress). The workpiece is fed to the downstream rolling stand by the upstream rolling stand or the pinch rolls by causing a compressive stress, which is below the yield stress at the rolling time, on the workpiece in a direction along the rolling line which is located between the upstream rolling stand or pinch rolls and the downstream rolling stand.

6 Claims, 11 Drawing Figures

METHOD OF ROLLING A METAL WORKPIECE

This is a continuation, of application Ser. No. 906,568, filed May 16, 1978, abandoned.

BACKGROUND OF THE INVENTION

This invention relates to a method of rolling a plate, billet, bar, or rod made of a metal workpiece, and particularly relates to a method of hot rolling of a metal workpiece which is capable of being rolled into a plate, billet, bar or rod stably with a large reduction of area or rate of elongation per pass.

In a conventional rolling operation wherein the reduction of area per pass is within 20–30%, in order to determine a maximum level of the reduction of area, a contact angle $\theta$ between the workpiece and a workroll must be considered. Namely, in any condition of rolling speed, roll workpiece and the like, in order to perform stable rolling, the contact angle $\theta$ must be in the relation of $\theta < \tan^{-1}\mu$($\mu$ denotes the coefficient of friction between the workpiece and workrolls during biting), and it is common practice to determine a maximum level of proper reduction of area within the range of such contact angle $\theta$.

On the other hand, with respect to the coefficient of friction between the workpiece and workrolls, assuming that the coefficient of friction in the steady rolling condition after the biting is completed is $\mu'$, the following relation is well known:

$$\tan^{-1}\mu' > \tan^{-1}\mu$$

From this relation, in the stationary rolling condition, rolling with a large contact angle as compared with the contact angle at the time of biting, namely, rolling with a high reduction of area in the range of $\theta \geqq \tan^{-1}\mu$ is possible.

A method of rolling a metal workpiece with a high reduction of area is disclosed in U.S. Pat. No. 4,106,318. In this method a metal workpiece is rolled by a rolling mill wherein the workrolls are supported so that the rolls do not shift in the advancing direction of the workpiece, and a gap between the workrolls is so adjusted to keep the contact angle $\theta$ in the relation of $\theta \geqq \tan\mu$, and the rolling is performed while the workpiece is continuously pushed between the rolls having the foregoing gap, with a of pushing force of a magnitude such that a neutral point of the rolling is caused to exist in the plane where the workrolls and the workpiece contact. However, in this method, there is required a pushing device such as a large scale pusher for pushing the workpiece continuously with stability over the entire length of the workpiece between the workrolls. Therefore, there is the drawback that the continuous rolling with the high reduction of area per one pass over a plurality of stands is extremely difficult. As the pushing device for eliminately this drawback, for example, a masterslave pusher system is available. In such device, to the first stand, the workpiece is pushed in by a master pusher, and to the second stand, the workpiece is pushed in that pass through the first stand. However, in this device, in order to push the workpiece through the workrolls continuously, two passes is a limit, and pushing through more than two passes is substantially impossible. Accordingly, there is a limit in the effect of making the rolling mill train into a compact size by employing such high reduction rolling system. Furthermore, as a method of pushing the workpiece, there is a method of pushing the workpiece into the roll gap by means of pinch rolls or of the rolling mill itself, and in these methods, the foregoing problems arising from the use of the pusher apparatus can be eliminated. However, when the pushing force becomes zero between the pinch rolls and the rolling mill or between the rolling mills, the workpiece is rolled under a non-stationary condition. Because of this phenomenon, there is the danger of defective biting, and also greater fluctuation in the dimensions of the width direction occurs, resulting in adverse influences with respect to the rolling operation, yield and product quality. In order to solve such problems, the rolling operation may be performed by connecting the preceding and succeeding workpieces by means of welding, but for this operation, another installation becomes necessary, thus extremely complicating matters related to technical and installation aspects. Also, the pushing force applied to the workpiece exerts an influence over the deformation of the workpiece between the workrolls, and as a result, spreading in the width direction over the entire length of the workpiece is increased, which gives rise to the deterioration of deformation efficiency.

As an example of a method of rolling a workpiece with a high reduction of area where the contact angle $\theta$ becomes $\theta > \tan^{-1}\mu$, the method of U.S. Pat. No. 3,553,997 is known. This rolling method is a method of performing an in-line reduction in a continuous casting wherein a front end of the workpiece is made to pass between the workrolls to a certain extent by opening the gap of the workrolls sufficiently and the workpiece is gripped by the workrolls. Then, the roll gap is made smaller to perform the rolling with the large contact angle. In this rolling method, it is possible to roll the workpiece with the high reduction of area, but the tip portion of the workpiece is off gauge, thus lowering the yield. This method has other problems such as that the roll gap has to be changed for every piece of the workpiece, and the rolling installations become complicated and large in size. Furthermore, in this rolling method, the cross section of the tip portion of the workpiece is larger than the cross section of the latter part thereof, and also it changes rapidly whereby a dynamic movable guide is required at the incoming side of the rolling stand of the next stage, and the rolling speed has to be changed according to the change of cross section, thus requiring a complicated control mechanism. Also, in this rolling method, in case of groove rolling, the front end portion of the workpiece whose cross section is large does not fit the groove, and thus the rolling of a billet, bar, and rod is almost impossible.

Heretofore, as a method of assisting the biting of the workpiece, a method of cutting the tip of the workpiece in wedge form or a method of pushing the workpiece between the workrolls by causing another cold or hot workpiece to collide with acceleration against the rear of the workpiece have been employed. However, these methods are employed in normal rolling operations wherein the contant angle $\theta$ is in the relation of $\theta < \tan^{-1}\mu$. Moreover, in these methods, there are too many problems with respect to yield, maintenance of the installation, stability of operation, and the like, and therefore such method are not practical.

SUMMARY OF THE INVENTION

An object of this invention is to solve the foregoing problems in a rolling operation conducted with a high reduction of area, and to provide a rolling method capable of rolling a plate billet, bar or rod made of a metal workpiece with high operating efficiency and yield and without generating faults.

Another object of this invention is to provide a rolling method wherein it is possible to decrease the diameter of the workrolls and to reduce the number of units of rolling stands, whereby the rolling mills can be made of a remarkably compact size.

A further object of this invention is to provide a simple rolling method capable of rolling the workpiece with a high reduction of area by adding simple devices to the rolling apparatuses installed.

The metal workpiece rolling method of the present invention to achieve the foregoing objects is as follows.

A metal workpiece is rolled by a rolling mill of the type including a first rolling stand or pinch rolls and more than one rolling stands disposed successively to such first stand or rolls. The roll gaps of the workrolls of the rolling stand at the rear side are set so that the equivalent contact angle $\theta e$ ($\theta e = \tan^{-1}(\cos\alpha \times \tan\theta)$ wherein $\theta$ denotes the contact angle between the workrolls in the bottom of the roll groove and the workpiece and $\alpha$ denotes the inclined angle of the groove) is larger than $\tan^{-1}\mu$ ($\mu$ denotes a coefficient of friction between the workpiece and the workrolls at the time of biting therebetween and also is smaller than $\tan^{-1}\mu'$ ($\mu'$ denotes a coefficient of friction between the workpiece and the workrolls when the workpiece is completely bitten between the workrolls and the rolling is in progress). The workpiece is fed to the rolling stand of the rear side by the first rolling stand or the pinch rolls of the front side by causing a compressive stress which is below the yield stress at a rolling time on the workpiece in the direction along the rolling line which is located between the first rolling stand or pinch roll at the front side and the rolling stand at the rear side, then enabling the workrolls of the rolling stand of the rear side to bite the workpiece. The peripheral speed of the workrolls and/or the pinch rolls are adjusted after the tip portion of the workpiece is completely bitten between the workrolls of the rolling stand of the rear side, while the workrolls remain with the previously set roll gap. The rolling is continued where the stress on the workpiece in the direction along the rolling line between the rolling stand of the rear side or pinch rolls of the front side does not exit or is not generated. Thus, the workpiece can be rolled with a high reduction of area which cannot be achieved by conventional rolling mills.

DESCRIPTION OF THE PREFERRED EMBODIMENTS

Figure 1:
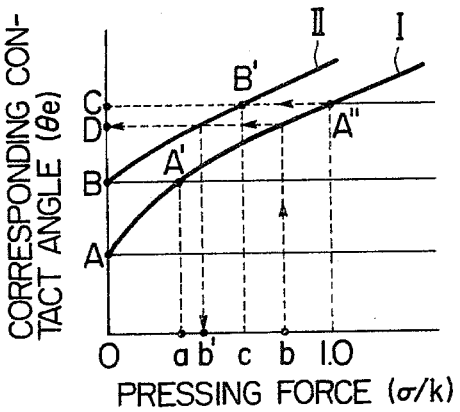
FIG. 1 is a graph showing the relationship between the pushing force and the equivalent contact angle.
Figure 2A:
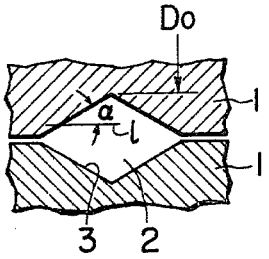
FIG. 2 is a diagram for explanation of the equivalent contact angle, wherein FIG. 2*a* explains the inclined angle of the groove, and FIG. 2*b* explains the contact angle at the groove bottom of the roll.
Figure 2B:
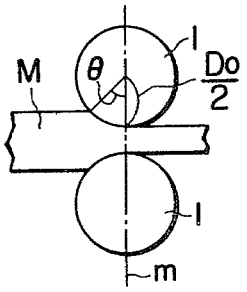

FIG. 1 is a graph showing schematically the relationship between the pushing force for pushing a workpiece between workrolls and the contact angle of the workrolls against the workpiece. In the graph, the pushing force is represented by $\sigma/k$ which is the ratio of the compressive stress generated in the workpiece at the pushing time against the yield stress k of the workpiece at the rolling time. Also, the contact angle is represented by the equivalent contact angle $\theta e$ which has amended the inclined angle of the groove of the workroll. As shown in FIG. 2*a*, an angle formed by the working surface 3 of the groove 2 of the workrolls 1 with the line l in parallel with the roll axis is made as $\alpha$, and as shown in FIG. 2*b*, the contact angle at the bottom diameter $D_o$ of the groove of the roll is made as $\theta$, the equivalent contact angle $\theta e$ is represented as follows.

$$\theta e = \tan^{-1}(\cos\alpha \times \tan\theta)$$

Also, in the case of the oval groove, an oval groove may be replaced by an angular groove and the inclined angle of the angular groove is made the inclined angle of the oval groove. The area of the substituted angular cross section and the longer diagonal line are equal to the area of the cross section of the oval groove and the long axis thereof, and in the case of rolling by a flat roll, since $\alpha = 0$, $\cos\alpha = 1$, and when this equivalent contact angle $\theta e$ is used, both groove rolling and flat rolling can be inclusively represented.

In the meantime, the curve I shown in FIG. 1 shows the equivalent contact angle of the limit of biting the workpiece in the rolls. The point A represents the equivalent contact angel of the limit of biting the workpiece between the workrolls without pushing force, and the amount is, as described in the foregoing, $\theta e = \tan^{-1}\mu$. The curve II shows the limit of rolling the workpiece in a steady condition after biting the workpiece between the workrolls, namely, the limit of generating slip between the workpiece and the workrolls. For example, the graph shows that if a pushing force b is given, a rolling of a high reduction of area wherein the maximum equivalent contact angle is D is possible. And, in this case, the curve II shows that after the workpiece is bitten into the workrolls, the rolling can be steadily performed with the pushing force b'. Also, the point B shows the equivalent contact angle of the limit of rolling the workpiece steadily without the pushing force after the workpiece is bitten into the workrolls, and the amount is, as described by the foregoing, $\theta e = \tan^{-1}\mu'$.

The range wherein the equivalent contact angle $\theta e$ is from O to A is a range where the workpiece is bitten in the workrolls with the pushing force being zero, and the rolling of the conventional ordinary reduction of area determines the rolling condition based on the equivalent contact angle within this range. Also, the range of B-C is a range wherein the workpiece is bitten with the pushing force within the yield stress at the rolling of the workpiece and even after the completion of the biting, the pushing force is applied continuously whereby the rolling is performed, and the foregoing high reduction rolling method belongs to this range. Furthermore, assuming that the pushing force is 1.0, the biting can be effected with the equivalent contact angle of the point C. At this time, the minimum required pushing force for continuing the steady rolling becomes the pushing force c represented by the intersection of the line perpendicular to the axis of the abscissa from the point B' on the curve II with the axis of the abscissa. Also, when the pushing force exceeds 1.0, the workpiece at the time of the biting receives a pushing force above the yield stress, and is deformed just before the rolling mill so that the range of the equivalent contact angle is greater than the point C. In this range, for example, the high reduction extrusion method is employed for rolling the heated workpiece housed in the container while pushing it into the forming aperture portion by the pushing conducted by the pushing device.

The rolling method of this invention is such that the range of the equivalent contact angle is the range of A-B shown in FIG. 1, and the amount of the equivalent contact angle is not comparable to those of the high reduction rolling method and the high reduction extrusion method, but it exceeds the reduction of area of the conventional method. Also, in the high reduction extrusion method, the continuous rolling of more than two passes is substantially impossible, and also even in the high reduction rolling method, the continuous rolling of substantially up to two passes is a limit as described in the foregoing, and as compared with such known method, the rolling method of this invention has a merit of being capable of rolling the workpiece continuously more than two passes.

In general, in the rolling of a billet, bar and rod, normally the total elongation from the starting material to the product is 400–500 which is frequently used, and also there is the following relationship between the total elongation λ total and the elongation λi for each pass.

$$\lambda_{total}=\lambda_o, \lambda_1, \lambda_2 \ldots \lambda_n$$

The important technical problem is how large the elongation for each pass should be made or how to continue the plural rollings with high elongation. The gist of the invention resides in this point.

The pushing force employed in the rolling method of this invention is basically in the range of O-a in FIG. 1, and also, in this case, the range of the reduction of area that can be achieved is the range of A-B in terms of the equivalent contact angle as described in the foregoing, namely, $\tan^{-1}\mu<\theta e \leqq \tan^{-1}\mu'$. Accordingly, when the workpiece is bitten into by the workrolls, the equivalent contact angle B can be achieved by applying the pushing force a.

Also, in this invention, after the initial biting of the workrolls into the workpiece is completed, in the condition where the stress in the direction along the rolling line is not generated on the workpiece, the rolling is continued. The time when the tip portion of the workpiece reaches the roll center line m (refer to FIG. 2*b*), over the entire cross section of the workpiece, is the time when the biting of the workpiece is completed, and even if a local portion of the tip of the workpiece (for example a crop portion) reaches the roll center line m, the biting of the workpiece is not completed.

Figure 3:
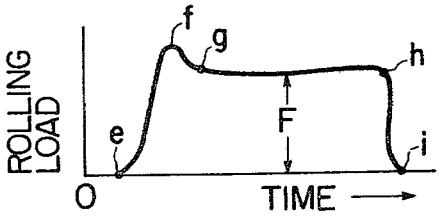
FIG. 3 is a graph showing schematically the condition where the rolling load changes with elapse of time.

FIG. 3 shows diagrammatically the change of the rolling load during the rolling, and the point e shows that start of biting, namely the start of contact between the workpiece and the workrolls, the point f shows completion of biting, the point g shows the point where the stress of the direction along the rolling line is no longer applied to the workpiece, the point h shows the start of the release of the workpiece, and the point i shows the completion of the release. In FIG. 3, the portion between the point e and the point g is a section of unsteady rolling where the rolling load fluctuates greatly, and the portion between the point g and the point h is a section where the rolling load is a fixed value F and the rolling is performed steadily. After the rolling reaches the steady condition, even if the pushing force is made zero, the equivalent contact angle in FIG. 1 is within the range below the curve II, and therefore there occurs no slip between the workpiece and the workrolls.

The condition of the point f can be detected by the load cell, hot metal detector and the like. Also, the point g shifts by the timing of adjustment of the peripheral speed of the rolls, but, for example, the following method of timing can be employed. Namely, the rolling average load F at the steady rolling period will be known from past rolling performances, and only after the workpiece is bitten into the workrolls, the rolling load F rises, and when it reaches 0.8 F, the timer is operated and after the elapse of proper time, the peripheral speed of the roll is adjusted to eliminate the stress in the direction along the rolling line working on the workpiece.

As described in the foregoing, the magnitude of the pushing force is basically the magnitude of the range of O-a in FIG. 1. However, in order to obtain a stable pushing force, the magnitude of the pushing force is desirably the magnitude where the compressive stress generated on the workpiece by the pushing becomes above 1%. Also, the pushing force may be the magnitude of above the point a to ascertain the biting of the workpiece. However, before the workpiece is bitten into by the workrolls in order to prevent the stress generated on the workpiece from exceeding the yield stress and plastic deformation from occurring, it is necessary that the compressive stress generated on the workpiece be below the yield stress of the workpiece at the rolling time, namely, $\sigma/k$ in FIG. 1 is below 1.0.

Figure 4:
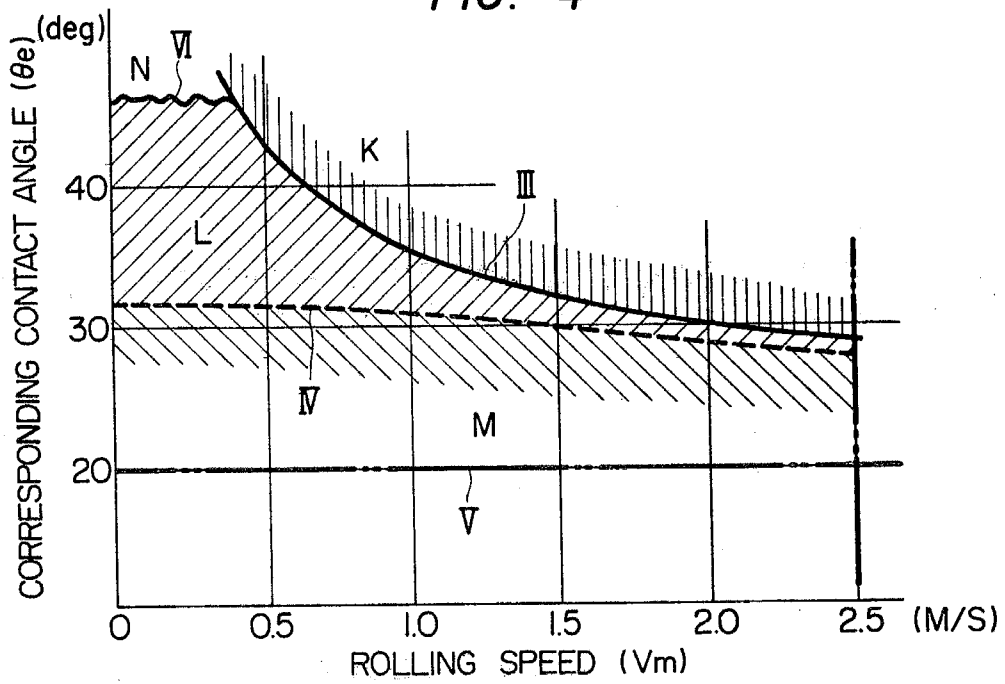
FIG. 4 is a graph showing the relationship between the rolling speed and the equivalent contact angle.

As described in the foregoing, after the completion of biting of the workpiece, steady rolling is performed, but the peripheral speed of the rolls is the speed that does not generate slip between the workrolls, set with a roll gap wherein the equivalent contact angle $\theta e$ is $\tan^{-1}\mu<\theta\leqq\tan^{-1}\mu'$, and the workpiece. As shown in FIG. 4, between the rolling speed Vm and the equivalent contact angle $\theta e$ that can be obtained, there is a close relationship. The results of FIG. 4 are obtained on a hot steel workpiece.

The curve III of FIG. 4 becomes obvious from the results of various experiments, and in the case where the pushing force is made zero, it shows the curve of a limit of generation of slip between the workpiece in the steady rolling condition and the workrolls. The upper region K above the curve III is a region where continuous rolling is difficult due to the generation of slip. The curve IV shows the result of experiments conducted by the inventors during hot rolling employing workrolls whose roll surface is rough, and it shows the curve of a limit of biting where the pushing force is zero. The upper region L of the curve IV represents the region where biting is difficult unless a pushing force is applied, and the lower region M of the curve IV is a region where the biting is possible without applying the pushing force. Curve IV perfectly coincides with the result disclosed by W. Tafel (literature "Stahl und Eisen" 1921). The curve V is a curve showing the equivalent contact angle of the maximum level employed in the present hot rolling operation, and it can be said that a great margin is given to the contact angle. The curve VI renders no problem from the point of slip but in the region N above the curve VI, due to the falling or buckling of the workpiece, scars or flows occur and represents a limit curve that has practically no significance.

In FIG. 4, the rolling speed adopted in this invention is the speed corresponding to the region enclosed by the curves III, IV and VI. At this speed, in the steady rolling condition, as will be understood from the foregoing, there occurs no slip between the workpiece and the workrolls. When the rolling speed such as the actual billet mill and rod rough rolling mill train is made to correspond to the rolling speed shown in FIG. 4, it becomes a range of roughly below 2.5 M/S. Namely, in FIG. 4 the rolling speed range adopted in this invention matches perfectly with the actual rolling installation for a billet, bar and rod. Inversely speaking, the rolling method of this invention shows its effectiveness particularly in the rough rolling of a billet, bar and rod. Furthermore, at the high speed side, the curves III and IV approach each other, and no substantial significant difference is recognized between the two curves. This rolling speed is generally 2.5 M/S.

In the following, a concrete method of carrying out the rolling operation of the present invention will be described.

Figure 5:
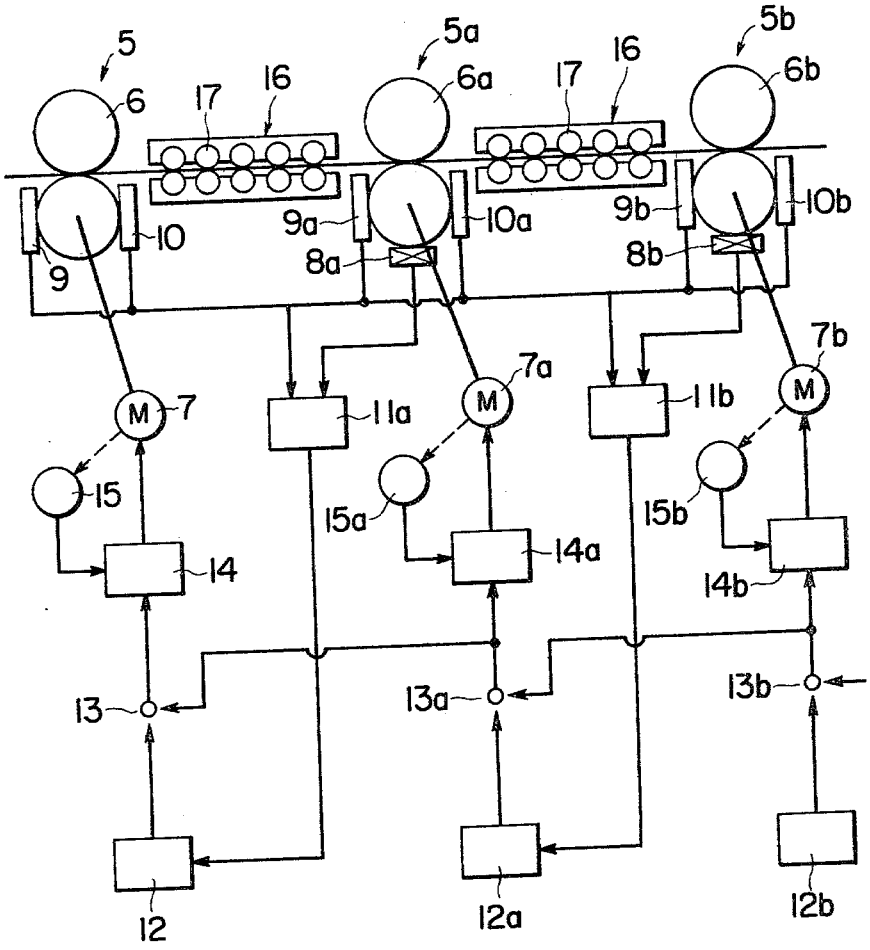
FIG. 5 is a schematic drawing showing one example of the rolling mill for carrying out the method of this invention.

FIG. 5 shows an example of a rolling mill for achieving the method of this invention. The roll gap of the workrolls 6 of a first stand 5 is set similar to an ordinary stand, namely, the equivalent contact angle $\theta e$ becomes $\theta e < \tan^{-1}\mu$, but the roll gap of the workrolls 6*a* and 6*b* of second and third stands 5*a*, 5*b* are previously set so that the equivalent contact angle $\theta e$ becomes $\tan^{-1}\mu < \theta e \leqq \tan^{-1}\mu'$.

In the first place, the workpiece M is supplied to the first stand 5 by the ordinary means, namely, the roller tables, but since the roll gap is previously set as described in the foregoing, the workpiece M is bitten into by the workrolls 6 of the first stand 5 without depending on any particular means. The workpiece M passing through the first stand 5 toward the second stand 5*a* will be guided by a buckling preventing device 16. Until the tip of the workpiece M reaches the second stand 5*a*, no stress in the direction along the rolling line is generated on the workpiece M. However, when the tip of the workpiece M reaches the second stand 5*a*, since the roll gap of the workrolls 6*a* of the second stand 5*a* is set previously, the workpiece M is not immediately bitten into by the workrolls 6*a*, and a compressive stress in the direction along the rolling line is generated on the workpiece M disposed between the first stand 5 and the second stand 5*a*. In this condition, as the workpiece M is continuously discharged from the first stand 5, the compressive stress on the workpiece M becomes gradually larger, and finally, it exceeds the value shown in the curve I of FIG. 1, and the workpiece M is bitten into by the workrolls 6*a* of the second stand 5*a*.

In the condition where the workpiece M is completely bitten into by the workrolls 6*a* of the second stand 5*a*, the point f of the rolling load shown in FIG. 3 can be detected by means of a load cell 8*a*, and a detecting signal therefrom is transmitted to a tension detecting signal amplifier 11*a*. On the other hand, the load cells 9 and 10 are provided on the first stand 5 and the load cells 9*a* and 10*a* are provided on the second stand 5*a*, and the tension of the workpiece M between the first stand 5 and the second stand 5*a* (namely, the stress in the direction along the rolling line with a minus value showing a compressive stress) is detected by the load cells 10 and 9*a*. The tension detecting signal is amplified by the tension detecting signal amplifier 11*a*, and is transmitted to the tension control device 12. The output signal from the tension control device 12 is compared with the output signal from a comparator 13*a* at a comparator 13. Also the rotating speed of a drive motor 7 is detected by a tachometer generator 15, and the signal therefrom is applied together with the signal from the comparator 13 to an automatic speed control device 14. The automatic speed control device 14 controls the rotating speed of the drive motor 7 so that the tension is not applied to the workpiece M disposed between the first stand 5 and the second stand 5*a*.

The workpiece M discharged from the second stand 5*a* is bitten into by the third stand 5*b*, and when continuing the rolling, similarly the tension control of the workpiece M between both the stands is performed by controlling the rotating speed of a drive motor 7*a* by the devices such as a tension detecting signal amplifier 11*b*, tension control device 12*a*, tachometer generator 15*a* and the like on the basis of the signals from load cells 8*b*, 10*a* and 9*b*. In this case, the tension between the first and second stands changes, and in order to hold down the change, the output signal that matches the output signal from the comparator 13*a* is transmitted to the comparator 13 to perform the control of the rotating speed of the drive motor 7*a*, and at the same time, the control of rotating speed of the drive motor 7 is performed. As described in the foregoing, in case the speed of the upstream stand is changed, the speeds of all of the stands downstream from such stand are changed sucessively. FIG. 5 shows only three stands but in case further rolling stands are successively disposed, the tension of the workpiece M disposed between the third stand 5*b* and the next stand is controlled by controlling the speed of the drive motor 7*b* by the devices such as the load cell 10*b*, control devices 12*b*, 14*b*, comparator 13*b* and tachometer generator 15*b*, and the like, in a manner similar to that described in the foregoing. Although the foregoing description relates to a control method of a known upstream system, this invention is not limited to such upstream system but also may be achieved by a control method of a downstream system. These types of controls are known to those skilled in the art. The rotating speed of the workrolls may be adjusted by manual operation so that the tension is made zero on the basis of the detected tension.

In case the workpiece M is bitten into by the workrolls 6*a* of the second stand 5*a*, the peripheral speed of workrolls 6*a* of the second stand 5*a* is approximately set at $v_{R2} < \lambda_2 \cdot \lambda_{R1}$ and during the normal rolling operation, compression is slightly generated. In the inequality, $v_{R1}$ and $v_{R2}$ denote the respective peripheral speeds corresponding to the working diameter of the workrolls of the first stand and the second under non-tension conditions and $\lambda_2$ denotes the elongation on the second stand under a non-tension condition.

Of course, even if the ratio of the peripheral speeds of the workrolls of both stands is set to $v_{R2} \approx \lambda_2 \cdot v_{R1}$ wherein substantially non-tension and non-compression conditions are produced during the normal rolling operation, the tip of the workpiece M, as described in the foregoing, is finally bitten into by the workrolls as a result of generation of the compressive stress. In either case, when the workpiece is bitten into by the workrolls, temporarily between both the stands, a fixed condition of mass flow is not established. Also, when the peripheral speeds of the workrolls 6 and 6*a* are made to be equal to the peripheral speed of the steady condition or made to be a value similar thereto, the correction of the speeds of the workrolls 6 and 6*a* after the completion of the bitting is done with a minimum degree.

Figure 6A:
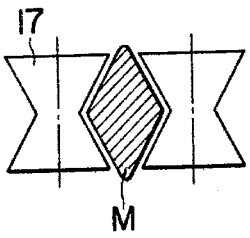
FIGS. 6*a*–6*c* are schematic elevation views showing examples of guide rolls which may be employed in the mill of FIG. 5.
Figure 6B:
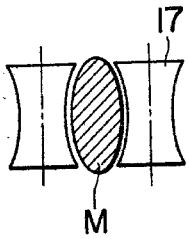
Figure 6C:
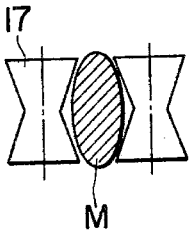

Each buckling preventing device 16 is provided with a plurality of pairs of rotatable guide rolls 17, and these guide rolls 17 extend to positions just before the workrolls 6*a* and 6*b* along the transfer direction of the workpiece M. As the workpiece M is guided by these guide rolls 17, no buckling occurs just before the stands 5*a* and 5*b*, and also the workpiece M is properly guided between the workrolls 6*a* and 6*b*. The cross sectional shape of the path formed by the guide rolls 17 is preferably similar to the cross sectional shape of the workpiece M as shown in FIG. 6*b*, but both the cross sectional shapes may be different from each other, as shown in FIG. 6*c*, as long as the buckling preventing and guiding functions are maintained.

In a rolling stand adopting a high reduction of area, the proper equivalent contact angle $\theta e$ at the lower side is normally selected with a certain margin as compared with that of the point B shown in FIG. 1. The reason for this is that it is necessary to apply the pushing force even though it is instant in the stand immediately at the lower stream except for the final stand, and also that the generation of trouble due to a sudden disturbance during the rolling can be avoided.

Furthermore, instead of the first stand 5, the pinch rolls may be used to bite the workpiece M into the second stand 5*a*. Also, instead of detecting the completion of biting of the workpiece M by means of the load cells 8*a* and 8*b*, such detection may be performed by employing the well known hot metal detector.

Figure 7:
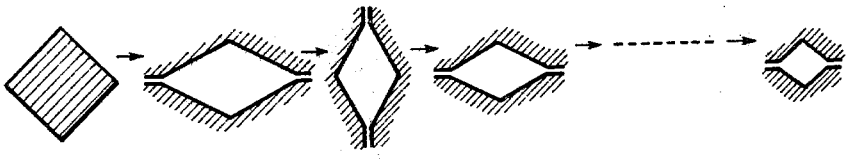
FIG. 7 is an explanatory diagram of a groove arrangement of a diamond-shaped system.
Figure 8:
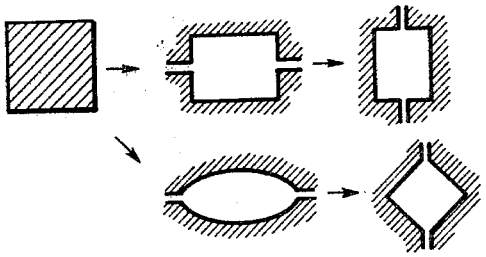
FIG. 8 is a diagram for explanation of groove arrangement of box system and oval system.

In the case of grooved rolling rolls, the grooves are formed in the rolls by a lathe, but a grooving system of the diamond-diamong type or diamond-square type as shown in FIG. 7 is advantageous from the standpoint of operation and obtaining a quality product or of achieving the desired high elongation. Also, the box-box system or oval-square system as shown in FIG. 8 may achieve the desired high elongation, but has the dangers of fall down of the workpiece or generation of wrinkles or flaws in the grooves, requires a high degree of technology, and is accompanied by considerable difficulties. In case the final cross sectional shape is of a square cross section such as a billet, the square groove with normal reduction rate to be employed in the conventional rolling may be disposed behind the diamond groove, and also, in case of a round steel bar, a square groove and round groove of normal reduction rate employed in the conventional rolling may be disposed behind a diamond groove.

As will be obvious from the foregoing detailed description, in this invention, there is a feature that high reduction continuous rolling can be performed similar to the continuous rolling with the conventional normal reduction of area without applying a tensile or compressive force to the workpiece in the range where the trouble of rolling operation is totally absent. This means the elimination of rolling under an unsteady condition, and is advantageous from the point of view of securing the dimensional accuracy and yield. Also, since the rolling can be performed continuously with a high reduction of area exceeding conventional standards, it is extremely advantageous from the standpoint of improving total elongation.

Furthermore, if a high reduction of area is desired, rolling with a high reduction of area can be made possible by decreasing the equivalent contact angle with the relatively larger diameter of the workrolls. However, in this case, the installations become unnecessarily large and are not practical. In this invention, the rolling can be performed with the high reduction of area by compact rolling installations having high efficiency and a required minimum diameter of workrolls.

The method of this invention and the conventional method will now be compared from the standpoint of installations with respect to the rolling of a product 100 mm square from 230 mm square steel starting material. Table 1 shows the comparison of the diameters of the workrolls of the rolling mill train for rolling the product.

TABLE 1

| | Method of this invention | | Conventional method | | |
|---|---|---|---|---|---|
| Stand No. | Roll dia. (MM) | Equivalent contact angle (degree) | Roll dia. (MM) | Equivalent contact angle (degree) | Rolling speed (M/S) |
| 1 | 596 | 30.0 | 988 | 20.0 | 0.45 |
| 2 | 651 | 38.0 | 1678 | 20.0 | 0.70 |
| 3 | 697 | 33.6 | 1599 | 20.0 | 1.20 |
| 4 | 608 | 30.6 | 1187 | 20.0 | 1.66 |
| 5 | 446 | 20.0 | 446 | 20.0 | 2.00 |

In this Table, the diameters of the rolls of the method of this invention are determined by the curve III of FIG. 4, and also the diameters of the rolls of the conventional method are determined by the curve V. The No. 5 stand of this invention performs the rolling with the conventional reduction of area. As will be obvious from this Table, in the method of this invention, the diameters of the rolls will be extremely small as compared with those of the conventional method. In case of the conventional method, the large diameter workrolls described above are not actually used, and it is a common practice that the diameter of the rolls be below 800 mm, and to compensate for such reduction in diameter, the number of stands is set at 7–8 units.

In the foregoing, description has been provided of the case where the workpiece is steel, but it is obvious from the constitution, operation and effect of this invention that the method of this invention can be applied to a workpiece made of materials other than steel, for example, aluminum alloy or copper alloy.

What is claimed is:

1. A method of rolling a metal workpiece in a rolling mill of the type having a plurality of roll stages including inlet roll means comprising upstream pinch rolls or an upstream first rolling stand having workrolls with grooves, and at least two downstream rolling stands having workrolls with grooves and being successively positioned downstream of said inlet roll means in the direction of rolling of a workpiece successively through said roll stages, said method comprising, for each adjacent pair of said roll stages:

setting the roll gap between the workrolls of the downstream-most rolling stand of each said pair such that an equivalent contact angle $\theta e = \tan^{-1}(\cos\alpha \times \tan\theta)$, wherein $\theta$ is the contact angle between the workpiece and each workroll from the bottom of the groove therein, and $\alpha$ is the inclined angle of said groove, such that said equivalent contact angle $\theta e$ is larger than $\tan^{-1}\mu$, wherein $\mu$ is the coefficient of friction between said workpiece and said workrolls during the initial biting of a leading end of said workpiece between said workrolls, and such that said equivalent contact angle $\theta e$ is less than $\tan^{-1}\mu'$, wherein $\mu'$ is the coefficient of friction between said workpiece and said workrolls after said workpiece is completely bitten between said workrolls and the rolling of said workpiece by said workrolls is in progress;

feeding said workpiece to said downstream-most rolling stand of each said pair by said pinch rolls or upstream-most rolling stand of each said pair by imparting a compressive stress on said workpiece, in said direction of rolling, of a value which is below the yield stress of said workpiece, until said workrolls of said downstream-most rolling stand bite therebetween said leading end of said workpiece; and after said leading end of said workpiece is completely bitten between said workrolls of said downstream-most rolling stand, adjusting the peripheral speed of said pinch rolls or of said workrolls of said upstream-most rolling stand, while maintaining said roll gap and while continuing the rolling operation, such that said compressive stress on said workpiece in said direction of rolling is eliminated, and such that no stress in said direction of rolling is imparted to said workpiece.

2. A method as claimed in claim 1, wherein said compressive stress is above 1.0% of said yield stress of said workpiece.

3. A method as claimed in claim 1, wherein the peripheral speed is adjusted to be below 2.5 m/s.

4. A method of rolling a metal workpiece in a rolling mill of the type having a plurality of roll stages including inlet roll means comprising upstream pinch rolls or an upstream first rolling stand, and at least two downstream rolling stands having flat workrolls and being successively positioned downstream of said inlet roll means in the direction of rolling of a workpiece successively through said roll stages, said method comprising, for each adjacent pair of said roll stages:

setting the roll gap between the workrolls of the downstream-most rolling stand of each said pair such that a contact angle $\theta$ between the workpiece and each workroll is larger than $\tan^{-1}\mu$, wherein $\mu$ is the coefficient of friction between said workpiece and said workrolls during the initial biting of a leading end of said workpiece between said workrolls, and such that said contact angle $\theta$ between the workpiece and each workroll is less than $\tan^{-1}\mu'$, wherein $\mu'$ is the coefficient of friction between said workpiece and said workrolls after said workpiece is completely bitten between said workrolls and the rolling of said workpiece by said workrolls is in progress;

feeding said workpiece to said downstream-most rolling stand of each said pair by said pinch rolls or upstream-most rolling stand of each said pair by imparting a compressive stress on said workpiece, in said direction of rolling, of a value which is below the yield stress of said workpiece, until said workrolls of said downstream-most rolling stand bite therebetween said leading end of said workpiece; and after said leading end of said workpiece is completely bitten between said workrolls of said downstream-most rolling stand, adjusting the peripheral speed of said pinch rolls or of said workrolls of said upstream-most rolling stand, while maintaining said roll gap and while continuing the rolling operation, such that said compressive stress on said workpiece in said direction of rolling is eliminated, and such that no stress in said direction of rolling is imparted to said workpiece.

5. A method as claimed in claim 4, wherein said compressive stress is above 1.0% of said yield stress of said workpiece.

6. A method as claimed in claim 4, wherein the peripheral speed is adjusted to be below 2.5 m/s.

* * * * *